US011078733B2

(12) United States Patent
Rothe et al.

(10) Patent No.: US 11,078,733 B2
(45) Date of Patent: Aug. 3, 2021

(54) APPARATUS AND METHODS FOR DETERMINING OPERATIONAL MODE OF TONG ASSEMBLY

(71) Applicant: Weatherford Technology Holdings, LLC, Houston, TX (US)

(72) Inventors: Jan Rothe, Hannover (DE); Heidi N. Cline, Cypress, TX (US); Frank Wern, Hannover (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 213 days.

(21) Appl. No.: 16/109,071

(22) Filed: Aug. 22, 2018

(65) Prior Publication Data

US 2020/0063509 A1 Feb. 27, 2020

(51) Int. Cl.
*E21B 19/16* (2006.01)

(52) U.S. Cl.
CPC ..... *E21B 19/165* (2013.01); *E21B 19/161* (2013.01)

(58) Field of Classification Search
CPC ..... E21B 19/16; E21B 19/161; E21B 19/165; E21B 47/00; E21B 47/0002; E21B 47/0905
See application file for complete search history.

(56) References Cited

U.S. PATENT DOCUMENTS 3,505,913 A * 4/1970 Dickmann ..... E21B 19/16 81/57.35
3,677,345 A * 7/1972 Sizer ..... E21B 19/143 166/384
3,780,815 A * 12/1973 Barron ..... E21B 19/165 173/195
3,882,377 A * 5/1975 Kelly ..... E21B 19/165 324/261
4,187,546 A * 2/1980 Heffernan ..... E21B 19/20 173/2
4,202,225 A * 5/1980 Sheldon ..... E21B 19/20 173/164

(Continued)

FOREIGN PATENT DOCUMENTS

CN 106930709 A 7/2017

OTHER PUBLICATIONS

Weatherford.com, 7.6-50 Hydraulic Tubing Tong (month unknown)/2013, https://www.weatherford.com/en/documents/technical-specification-sheet/products-and-services/tubular-running-services/7-6-50-hydraulic-tubing-tong/.*

(Continued)

*Primary Examiner* — Aaron L Lembo
(74) *Attorney, Agent, or Firm* — Patterson + Sheridan, LLP

(57) ABSTRACT

A system for tong assembly operation includes a mode switch for shifting the tong assembly between a first mode of operation and a second mode of operation, the mode switch having a first portion associated with the first mode and a second portion associated with the second mode; a first target coupled to the first portion, the first target movable to a first position corresponding to the first mode of operation; a second target coupled to the second portion, the second target movable to a second position corresponding to the second mode of operation; a first sensor configured to identify the first position of the first target; and a second sensor configured to identify the second position of the second target.

18 Claims, 4 Drawing Sheets

(56) References Cited

U.S. PATENT DOCUMENTS

| | | | | |
|---|---|---|---|---|
| 6,318,214 | B1 * | 11/2001 | Buck | E21B 19/164 81/57.16 |
| 7,313,986 | B2 * | 1/2008 | West | E21B 19/161 81/57.16 |
| 7,690,281 | B2 * | 4/2010 | Hobgood | E21B 19/165 81/57.35 |
| 7,707,914 | B2 * | 5/2010 | Pietras | E21B 19/168 81/57.16 |
| 7,975,572 | B2 | 7/2011 | Nelson | |
| 8,387,488 | B2 | 3/2013 | Pettit | |
| 8,550,174 | B1 * | 10/2013 | Orgeron | E21B 19/24 166/380 |
| 8,733,213 | B2 * | 5/2014 | Taggart | E21B 19/161 81/57.11 |
| 9,328,571 | B2 * | 5/2016 | Taggart | E21B 19/163 |
| 9,404,322 | B2 * | 8/2016 | Wiedecke | E21B 19/07 |
| 9,410,383 | B2 * | 8/2016 | Jahnke | E21B 17/085 |
| 9,453,377 | B2 | 9/2016 | Mosing et al. | |
| 9,551,194 | B1 * | 1/2017 | Baryam | E21B 19/163 |
| 9,551,195 | B1 * | 1/2017 | Baryam | E21B 19/163 |
| 9,803,436 | B2 * | 10/2017 | Richardson | E21B 19/16 |
| 9,995,095 | B2 * | 6/2018 | Thibodeaux | E21B 19/164 |
| 10,132,126 | B2 * | 11/2018 | Helms | E21B 19/06 |
| 10,366,507 | B2 * | 7/2019 | Amezaga | E21B 41/00 |
| 10,472,906 | B2 * | 11/2019 | Zimbelmann | E21B 19/163 |
| 10,480,291 | B2 * | 11/2019 | Wiedecke | E21B 44/00 |
| 2005/0133115 | A1 * | 6/2005 | Gatz | A01G 23/08 144/357 |
| 2013/0255446 | A1 | 10/2013 | Taggart | |
| 2015/0101826 | A1 | 4/2015 | Gupta et al. | |
| 2018/0340380 | A1 * | 11/2018 | Wern | E21B 19/165 |
| 2020/0063506 | A1 * | 2/2020 | Helms | E21B 19/165 |
| 2020/0141198 | A1 * | 5/2020 | Cline | E21B 19/164 |

OTHER PUBLICATIONS

PCT International Search Report and Written Opinion dated Nov. 8, 2019, for International Application No. PCT/US2019/047320.

* cited by examiner

APPARATUS AND METHODS FOR DETERMINING OPERATIONAL MODE OF TONG ASSEMBLY

BACKGROUND

Field

Embodiments of the present disclosure generally relate to an apparatus and methods for detecting an operational mode of a tong assembly.

Description of the Related Art

In many stages of the drilling and completion of an oil and gas well, tubular members are coupled end-to-end to form what is known as a string. Typically, tubular members are made up in approximately 30-90 foot segments known as pipe stands, and include threaded couplings at each end. Commonly known as box and pin connections for the female and male portions, respectively, the threaded connections serve to both form a fluid seal between the tubular segments and to resiliently couple the adjacent tubulars.

When making-up a drill string, multiple rotations of one of the tubulars are required to fully engage the threads of the box with the threads of the pin. Tongs are used to deliver torque to a set of jaws that grip the tubulars being threaded together. A power tong is used to deliver torque and rotation to one of the tubulars while a backup tong maintains the other tubular rotationally stationary.

Some tongs include a make/break switch for switching the tong assembly between makeup and breakout of a threaded connection. The make/break switch is mounted to a rotational portion of the tong assembly. In some tongs, the make/break switch cannot provide feedback about the operational mode of the tong assembly due to the rotation of the make/break switch relative to control systems of the tong assembly. Direct wired connections between the make/break switch and the control system are not possible due to the rotation of the make/break switch.

Therefore, there is a need for improved methods and apparatus for detecting an operational mode of a tong assembly.

SUMMARY

The present disclosure generally relates to apparatus and methods for detecting an operational mode of a tong assembly.

In one embodiment, a system for tong assembly operation includes a mode switch for shifting the tong assembly between a first mode of operation and a second mode of operation, the mode switch having a first portion associated with the first mode and a second portion associated with the second mode; a first target coupled to the first portion, the first target movable to a first position corresponding to the first mode of operation; a second target coupled to the second portion, the second target movable to a second position corresponding to the second mode of operation; a first sensor configured to identify the first position of the first target; and a second sensor configured to identify the second position of the second target.

In another embodiment, a system for tong assembly operation includes a tong having a stationary portion and a rotational portion; an activator switch attached to the stationary portion; and a mode switch attached to the rotational portion, the mode switch configured to shift the tong between a first mode of operation and a second mode of operation. The system also includes a first target attached to the mode switch; a second target attached to the mode switch; a first sensor configured to detect the first target when the tong is in the first mode of operation; and a second sensor configured to detect the second target when the tong is in the second mode of operation.

In another embodiment, a method for determining an operational mode of a tong includes rotating a first target relative to a first sensor; rotating a second target relative to a second sensor; identifying a position of the first target with the first sensor; and analyzing the position of the first target to determine the operational mode of the tong.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Figure 1:
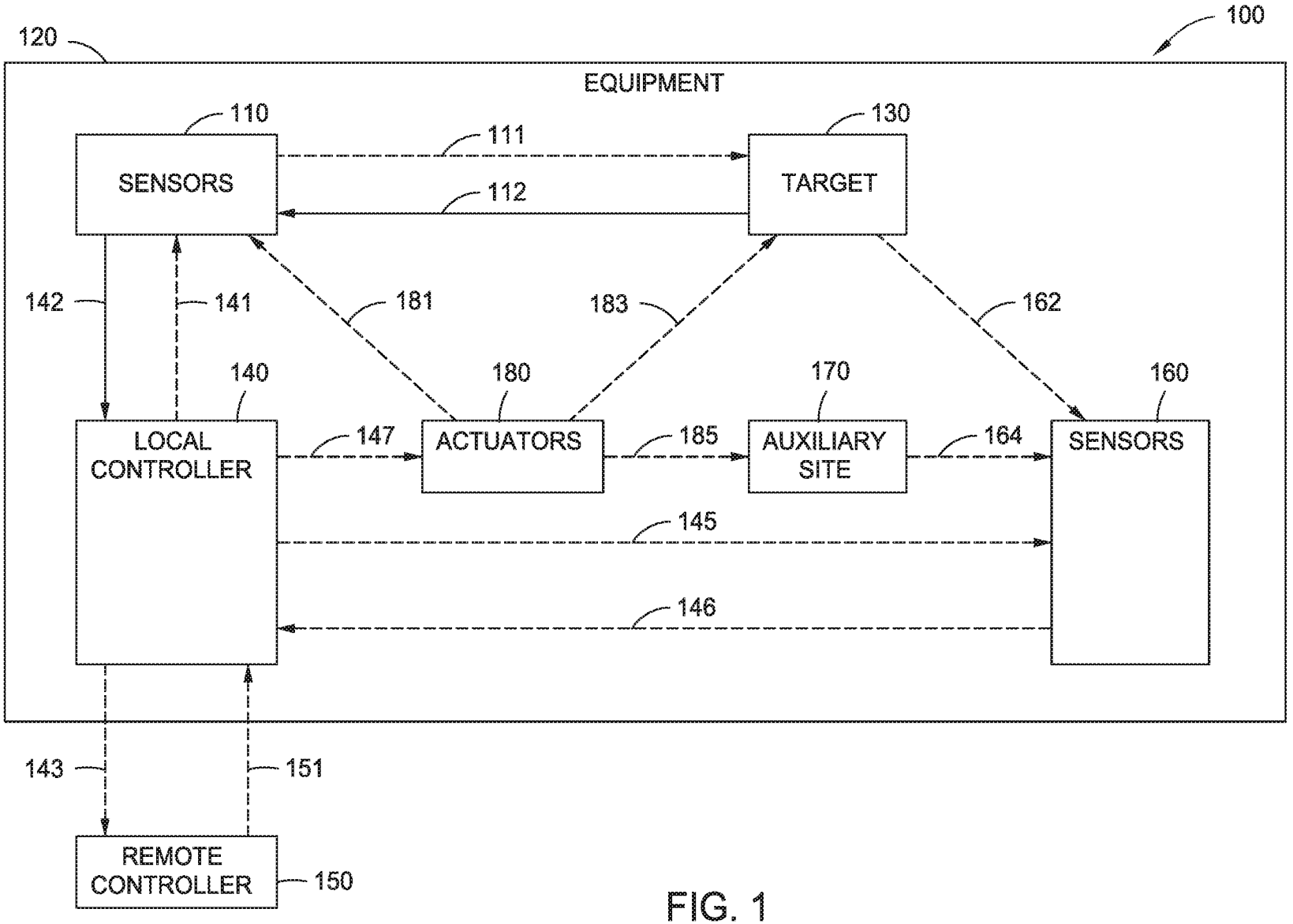
FIG. 1 illustrates an exemplary sensor system for a tong assembly according to embodiments of the present disclosure.

An exemplary sensor system 100 is illustrated in FIG. 1. In the illustrated embodiment, one or more sensors 110 are located on equipment 120 (e.g., a tong assembly, power tong, and/or backup tong) on a rig. Exemplary sensors 110 include optical imaging devices, optical device such as a laser distance sensor, ultrasonic sensors, proximity sensors, etc. The sensor 110 may be configured to monitor and/or determine an operational mode of the tong assembly. For example, the sensor 110 detects a target 130 mounted to the power tong of the tong assembly. The sensors 110 are positioned to be able to detect measurements 112 about the target 130 on equipment 120. A local controller 140 is also located on the equipment 120. The local controller 140 is functionally connected to the sensor 110. For example, in some embodiments, the local controller 140 is able to send commands 141 to the sensor 110, and the sensor 110 is able to receive commands. As another example, the local controller is able to receive information 142 from the sensor 110, and the sensor 110 is able to send information 142. For example, the information 142 may be a signal in response to detection of the target 130 by the sensor 110. For example, the information 142 may be an optical image, results of image processing or object detection, the monitored and/or determined operational mode of the tong assembly, etc. In some embodiments, the local controller 140 is able to store, analyze, and/or retransmit the information 142 received from the sensor 110.

In some embodiments, the local controller 140 is able to send data 143 to a remote controller 150, and remote controller 150 is able to receive data 143. For example, the local controller is able to retransmit the information 142 as data 143. In some embodiments, the local controller 140 analyzes and/or processes the information 142, and the local controller 140 sends the results as data 143. The data 143 may be for example, the monitored and/or determined operational mode of the tong assembly. The remote controller 150 may be remote from the equipment 120. For example, the remote controller 150 is located in a control room of the rig, or the remote controller is at a location that is remote from the rig. The remote controller 150 may receive data 143 from the local controller 140 and/or other inputs (e.g., operator input, input from other systems on the rig, etc.). The remote controller 150 may analyze and/or process the data 143 and/or other inputs. The remote controller 150 may be able to send control commands 151 to local controller 140, and local controller 140 may be able to receive commands 151. Data, inputs, commands, and/or signals may be sent between local controller 140 and remote controller 150 over a variety of communication channels, including, for example, wires, fiber optics, hydraulic lines, pneumatic lines, and/or wirelessly, including electromagnetic or acoustic signaling.

In some embodiments, local controller 140 is functionally connected with other sensors 160 on equipment 120. The other sensors 160 are differentiated from the sensors 110. In some embodiments, the other sensors 160 acquire measurements about the operation of the equipment 120. For example, the other sensors 160 may include torque sensors, pressure sensors, etc. In some embodiments, the other sensors 160 acquire measurements about one or more auxiliary sites 170 on the equipment 120. In some embodiments, the local controller 140 is able to send commands 145 to the other sensors 160, and the other sensors 160 are able to receive commands 145. In some embodiments, the local controller 140 is able to receive information 146 from the other sensors 160, and the other sensors 160 are able to send information 146. In some embodiments, the local controller 140 is able to store, analyze, and/or retransmit the information 146 received from the other sensors 160. For example, the local controller analyzes information 142 from sensors 110 in combination with information 146 from the other sensors 160.

In some embodiments, local controller 140 is functionally connected with actuators 180 on equipment 120. For example, in some embodiments, the local controller 140 is able to send commands 147 (e.g., control signals) to the actuators 180, and the actuators 180 may be able to receive commands 147. The commands 147 may be based on, or in response to, the information 142, information 146, and/or analysis of information 142/146. In some embodiments, the commands 147 instruct the actuators 180 to cause action 181 (e.g., stopping rotation of the power tong and/or backup tong, movement of a rocker switch) at the equipment 120.

Figure 2:
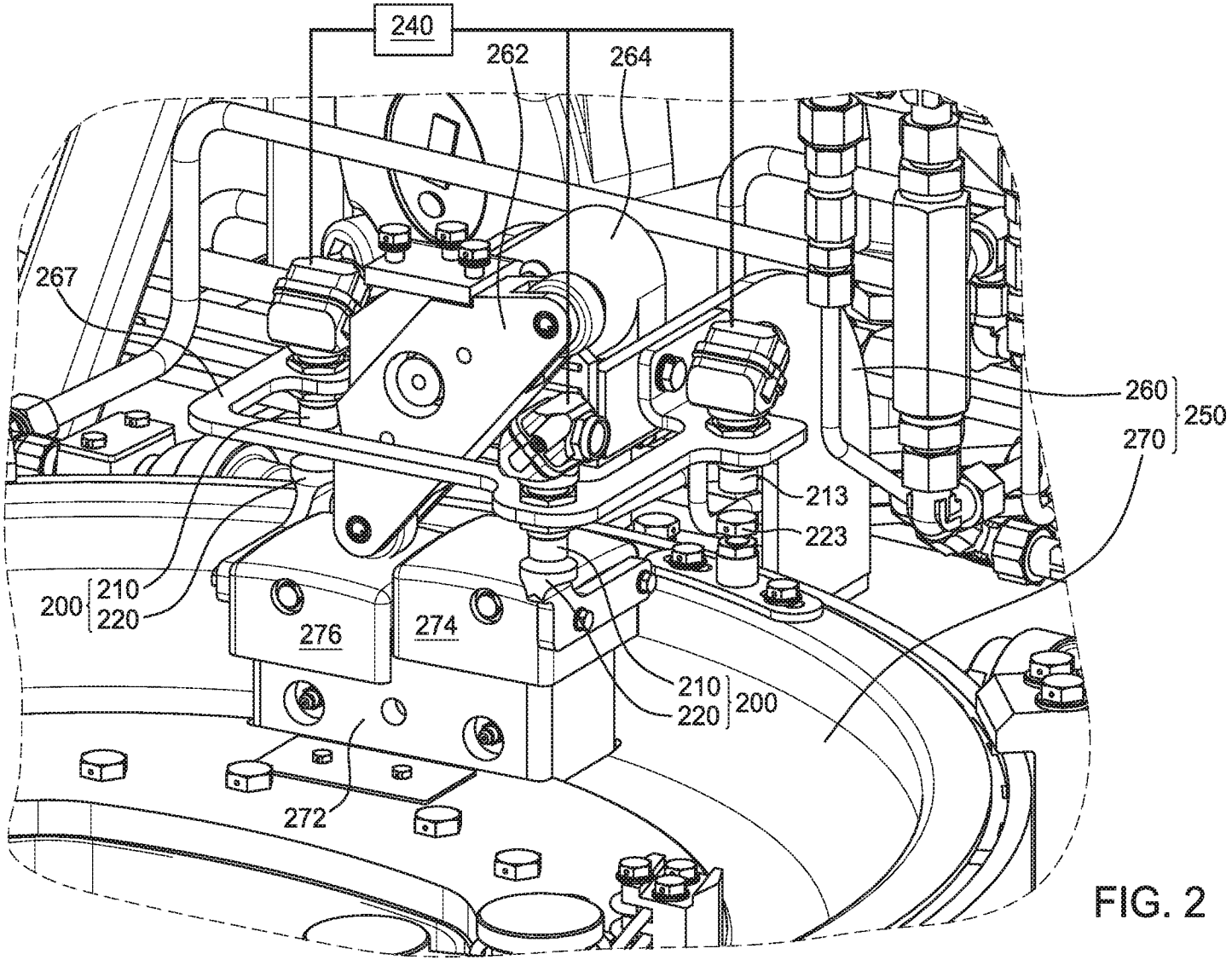
FIG. 2 illustrates another exemplary sensor system for a tong assembly according to embodiments of the present disclosure.

Another exemplary sensor system is illustrated in FIG. 2, which is a partial view of a power tong 250 according to embodiments of the present disclosure. The sensor system 200 may assist during operation of a power tong to makeup a tubular connection.

In one embodiment, the sensor system 200 is mounted on a power tong 250 of a tong assembly. The tong assembly may be coupled to and moved by a positioning system, such as a power arm. The tong assembly also includes a backup tong cooperating with the power tong 250 to makeup or breakout a tubular connection. The power tong 250 is configured to receive a pin end of a tubular joint and to engage and grip the pin end of the tubular joint. The power tong 250 is used to makeup or breakout a tubular connection. The power tong 250 includes a stationary portion 260 and a rotational portion 270. The power tong 250 includes an activator switch such as a rocker switch 262, an actuator 264, and a mode switch such as a make/break switch 272. The rocker switch 262 and the actuator 264 may be mounted to the stationary portion 260 of the power tong 250. The rocker switch 262 is actuated by the actuator 264 to operate the make/break switch 272. The make/break switch 272 may be mounted to the rotational portion 270 of the power tong 250. The make/break switch 272 may be configured to shift the power tong 250 between makeup and breakout operational modes. For example, the make/break switch 272 includes a mechanical linkage to the jaws of the power tong for gripping a tubular. The make/break switch 272 includes a first portion 276 such as a make button and a second portion 274 such as a break button. Depression of the first portion 276 or the second 274 will shift a gear set configured to rotate the tubular gripped by the jaws between makeup and breakout operational modes.

In one embodiment, the sensor system 200 is configured to determine an operational mode of the power tong 250. The sensor system 200 includes one or more sensors 210 mounted to the stationary portion 260 of the power tong 250. In this example, the sensors 210 are mounted to a bracket 267. The sensor system 200 also includes one or more targets 220. The targets 220 may be mounted to the make/break switch 272 of the power tong 250. For example, a first target 220 is mounted to the first portion 276, and a second target 220 is mounted to the second portion 274. The one or more sensors 210 may be configured to detect the position and/or location of the one or more targets 220. For example, in some embodiments, the one or more sensors 210 are optical imaging devices positioned to be able to capture an optical image of the one or more targets 220. In another example, each target 220 is detectable by a corresponding proximity sensor 210 when the target 220 is located within a predetermined distance to the proximity sensor 210. In one example, the targets 220 are positioned such that each target 220 is detectable by only one of the sensors 210. As shown in FIG. 2, the target 220 mounted to the second portion 274 is located further away from the edge of the rotational portion 270 than the target 220 mounted to the first portion 276. As the targets 220 rotate, the target 220 mounted to the second portion 274 is detected by the corresponding sensor 210, which cannot detect the target 220 mounted to the first portion 276 due to the location. Optionally, the sensor system 200 may include a sensor 213 configured to detect a zero-position target 223. A local controller 240 is also located on the power tong 250. The local controller 240 is functionally connected to the one or more sensors 210, 213.

The rotational portion 270 of the power tong 250 may rotate relative to the stationary portion 260. As a result, the one or more targets 220 and make/break switch 272 may rotate relative to the one or more sensors 210, rocker switch 262, and actuator 264. The sensor system 200 may be functionally connected to a local controller 240 also located on the power tong 250. The local controller 240 may be located on the stationary portion 260. The local controller 240 may be able to send data to and/or receive commands from a remote controller. The location of the sensors 210 on the power tong 250 may be changed according to operational and/or manufacturing specifications.

During operation, the sensors 210 may monitor and/or detect a position and/or location of the targets 220. The local controller 240 may be able to receive information from the sensors 220. For example, the information may include the detected position and/or location of the targets 220. The information may be analyzed to determine further information. In some embodiments, the local controller transmits the information to a remote controller. The remote controller may be able to receive information from the local controller. In some embodiments, the local controller may determine the operational mode of the power tong 250. For example, the sensors 210 may transmit information regarding the detected position and/or location of the targets 220. Based on the information, the local controller may calculate the operational mode by comparing the detected position and/or location with a predetermined location corresponding with an operational mode. In some embodiments, the remote controller may determine the operational mode of the power tong 250 based on the information.

In some embodiments, the local controller 240 may instruct the actuator 264 to operate the make/break switch 272. For example, the local controller may determine that the power tong is not in the correct operational mode based on the information from the sensors 210. The local controller may instruct the actuator 264 to rotate the rocker switch 262. The rocker switch 262 may engage the make/break switch 272 and shift the power tong 250 into the desired operational mode. In FIG. 2, the rocker switch 262 is rotated to depress the first portion 276 of the make/break switch 272. In this respect, the target 220 attached to the second portion 274 will rotate at a higher height, and closer to the sensors 210, than the target 220 attached to the first portion 276. In some embodiments, the local controller may compare the detected position and/or location of two targets 220 to ensure the power tong 250 is in the correct operational mode.

In some embodiments, the sensors 210 may be a wireless positioning sensor. The wireless positioning sensor may transmit information to the local controller. For example, the wireless positioning sensor may transmit an absolute position of the make/break switch 272 to the local controller. The local controller may determine the operational mode of the power tong based on the information.

Figure 3:
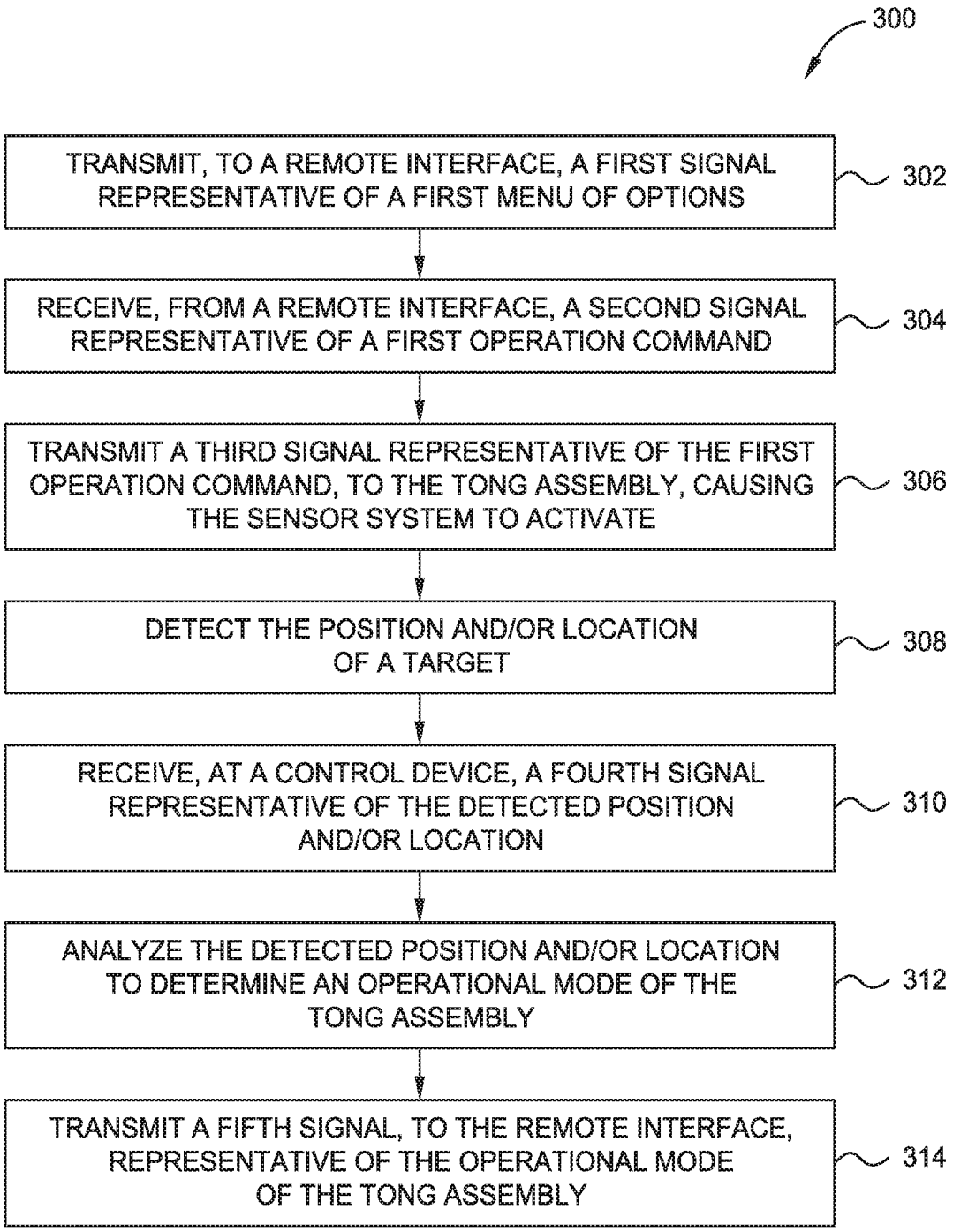
FIG. 3 illustrates an exemplary method utilizing a sensor system for a tong assembly.

FIG. 3 illustrates operations 300 that may be performed, for example, by a control device, such as local controller 140, to control the power tong at a work location, in accordance with embodiments of the present disclosure. Operations 300 may begin at 302, where the control device transmits a first signal representative of a menu of options to a remote interface, such as remote controller 150. The menu of options may, for example, represent operation commands for the power tong. For example, the operation commands may instruct the actuator 264 to operate the rocker switch. At 304, the control device receives from the remote interface a second signal representative of a first operation command. At 306, the control device transmits a third signal representative of the first operation command to the power tong, which may cause the sensor system to activate. At 308, the sensor system may detect the position and/or location of a target. At 310, the control device receives a fourth signal from the sensor system representative of the detected position and/or location. At 312, the control device analyzes the detected position and/or location of the target to determine the operational mode of the power tong. At 314, the control device transmits a fifth signal to the remote interface based on the analysis, which may display the operational mode of the power tong.

In some embodiments, operations 300 also include detecting a position and/or location of a second target with a second sensor. In some embodiments, operations 300 also include analyzing the detected position and/or location of the second target to determine the operational mode of the power tong.

Figure 4:
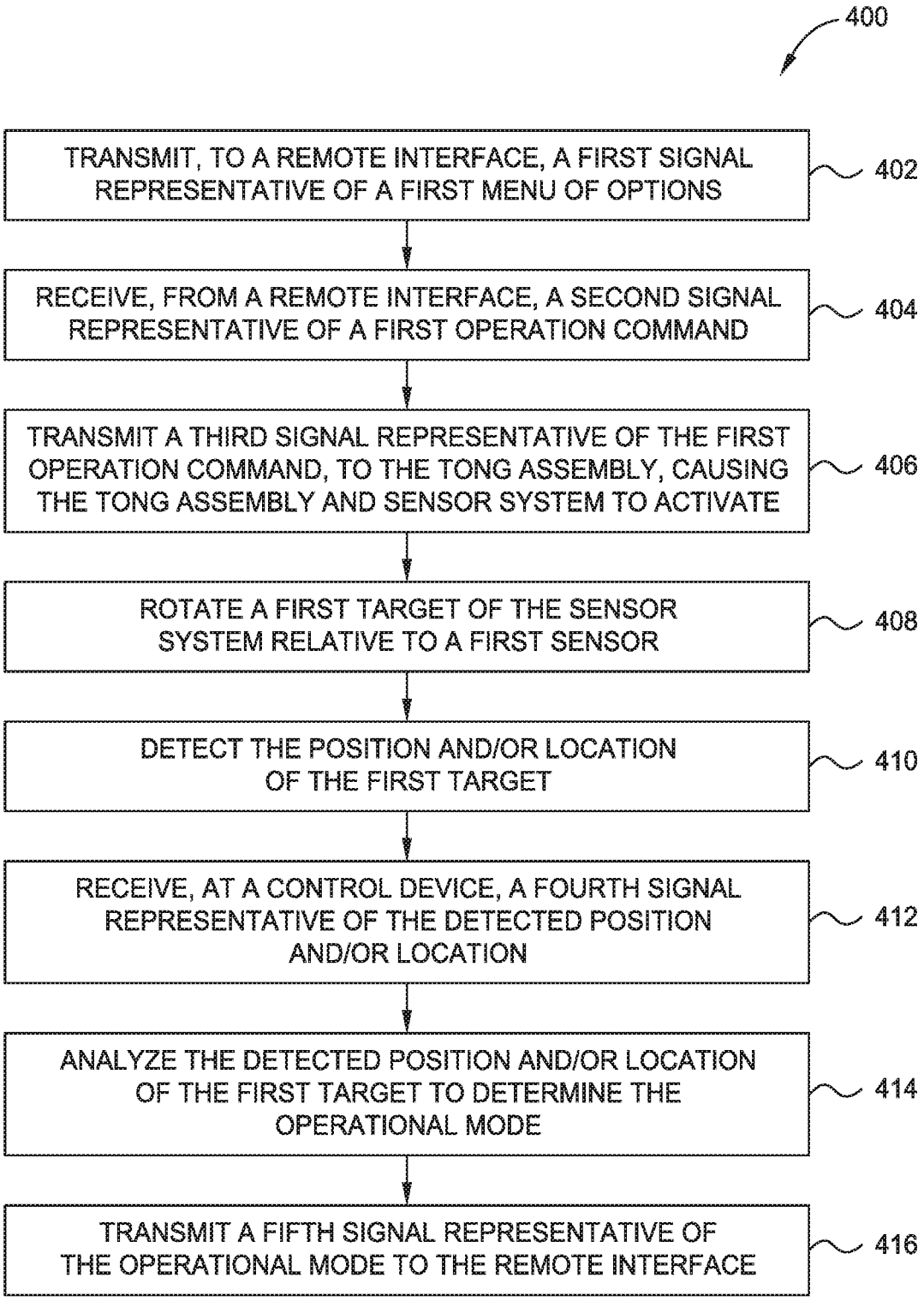
FIG. 4 illustrates another exemplary method utilizing a sensor system for a tong assembly.

FIG. 4 illustrates operations 400 that may be performed, for example, by a control device, such as local controller 140, to control the power tong at a work location, in accordance with embodiments of the present disclosure. Operations 400 may begin at 402, where the control device transmits a first signal representative of a menu of options to a remote interface, such as remote controller 150. The menu of options may, for example, represent operation commands for the power tong. For example, the operation commands may instruct power tong to begin an operation for makeup or breakout of a tubular connection. At 404, the control device receives from the remote interface a second signal representative of a first operation command. At 406, the control device transmits a third signal representative of the first operation command to the power tong, which may cause the power tong and the sensor system to activate. At 408, a first target of the sensor system is rotated relative to a first sensor. At 410, the first sensor detects the position and/or location of the first target. At 412, the control device receives a fourth signal from the sensor system representative of the detected position and/or location. At 414, the control device analyzing the detected position and/or location of the target to determine the operational mode of the power tong. At 416, the control device transmits a fifth signal to the remote interface based on the analysis, which may display the operational mode of the power tong.

In some embodiments, operations 400 may also include rotating a second target of the sensor system relative to a second sensor. Operations 400 may also include detecting a position and/or location of the second target with the second sensor. Operations 400 may also include receiving a signal from the sensor system representative of the detected position and/or location of the second target. Operations 400 may also include analyzing the detected position and/or location of the second target to determine the operational mode of the power tong.

In one embodiment, a system for tong assembly operation includes a mode switch for shifting the tong assembly between a first mode of operation and a second mode of operation, the mode switch having a first portion associated with the first mode and a second portion associated with the second mode; a first target coupled to the first portion, the first target movable to a first position corresponding to the first mode of operation; a second target coupled to the second portion, the second target movable to a second position corresponding to the second mode of operation; a first sensor configured to identify the first position of the first target; and a second sensor configured to identify the second position of the second target.

In one or more of the embodiments described herein, the first sensor is an optical imaging device.

In one or more of the embodiments described herein, the first target is configured to rotate relative to the first sensor.

In one or more of the embodiments described herein, the first sensor comprises a wireless positioning sensor configured to identify the first position of the first target, wherein the first target is rotatable relative to the wireless positioning sensor.

In one or more of the embodiments described herein, the first mode of operation corresponds to making up a tubular connection.

In one or more of the embodiments described herein, the second mode of operation corresponds to breaking out a tubular connection.

In one or more of the embodiments described herein, the first portion comprises a make button, and the second portion comprises a break button.

In another embodiment, a system for tong assembly operation includes a tong having a stationary portion and a rotational portion; an activator switch attached to the stationary portion; and a mode switch attached to the rotational portion, the mode switch configured to shift the tong between a first mode of operation and a second mode of operation. The system also includes a first target attached to the mode switch; a second target attached to the mode switch; a first sensor configured to detect the first target when the tong is in the first mode of operation; and a second sensor configured to detect the second target when the tong is in the second mode of operation.

In one or more of the embodiments described herein, the system includes an actuator configured to rotate the activator switch.

In one or more of the embodiments described herein, the system includes a third sensor configured to detect a zero position of the rotational portion.

In one or more of the embodiments described herein, the mode switch is movable to a first position to shift the tong to the first mode of operation.

In one or more of the embodiments described herein, the first mode of operation corresponds to making up a tubular connection.

In one or more of the embodiments described herein, the mode switch is movable to a second position to shift the tong to the second mode of operation.

In one or more of the embodiments described herein, the second mode of operation corresponds to breaking out a tubular connection.

In one or more of the embodiments described herein, the first target is positioned such that when the first target is detectable by the first sensor, the first target is not detectable by the second sensor.

In one or more of the embodiments described herein, the first sensor and the second sensor are mounted to a bracket.

In another embodiment, a method for determining an operational mode of a tong includes rotating a first target relative to a first sensor; rotating a second target relative to a second sensor; identifying a position of the first target with the first sensor; and analyzing the position of the first target to determine the operational mode of the tong.

In one or more of the embodiments described herein, the method includes shifting the operational mode of the tong.

In one or more of the embodiments described herein, the method includes identifying a position of the second target with the second sensor; and analyzing the position of the second target to determine operational mode of the tong has shifted.

In one or more of the embodiments described herein, the method includes detecting a zero position of the tong.

In one or more of the embodiments described herein, the first target is rotated at a higher height than the second target.

While the foregoing is directed to embodiments of the present disclosure, other and further embodiments of the disclosure may be devised without departing from the basic scope thereof, and the scope thereof is determined by the claims that follow.

The invention claimed is:

1. A system for tong assembly operation, comprising:

a tong having a stationary portion and a rotational portion;

an activator switch attached to the stationary portion;

a mode switch attached to the rotational portion, the mode switch configured to shift the tong between a first mode of operation and a second mode of operation, the mode switch having a first portion associated with the first mode and a second portion associated with the second mode, wherein the activator switch is configured to engage the first portion or the second portion to operate the mode switch;

a first sensor target attached to the first portion of the mode switch;

a second sensor target attached to the second portion of the mode switch;

a first sensor configured to detect the first sensor target when the tong is in the first mode of operation; and a second sensor configured to detect the second sensor target when the tong is in the second mode of operation.

2. The system of claim 1, further comprising an actuator configured to rotate the activator switch.

3. The system of claim 1, further comprising a third sensor configured to detect a zero position of the rotational portion.

4. The system of claim 1, wherein the mode switch is movable to a first position to shift the tong to the first mode of operation.

5. The system of claim 4, wherein the first mode of operation corresponds to making up a tubular connection.

6. The system of claim 1, wherein the mode switch is movable to a second position to shift the tong to the second mode of operation.

7. The system of claim 6, wherein the second mode of operation corresponds to breaking out a tubular connection.

8. The system of claim 1, wherein the first sensor target is positioned such that when the first sensor target is detectable by the first sensor, the first sensor target is not detectable by the second sensor.

9. The system of claim 1, wherein the first sensor and the second sensor are mounted to a bracket.

10. The system of claim 1, wherein the first portion comprises a make button, and the second portion comprises a break button.

11. The system of claim 10, wherein the first mode of operation corresponds to making up a tubular connection, and the second mode of operation corresponds to breaking out a tubular connection.

12. The system of claim 1, wherein the first sensor target is configured to rotate relative to the first sensor.

13. The system of claim 1, wherein the first sensor comprises a wireless positioning sensor configured to identify the first position of the first sensor target, wherein the first sensor target is rotatable relative to the wireless positioning sensor.

14. The system of claim 1, wherein the first sensor is an optical imaging device.

15. The system of claim 8, wherein the first sensor is located above the first sensor target and the second sensor is located above the second sensor target.

16. The system of claim 8, wherein the first sensor target is located at a different radial distance from an edge of the rotating portion than the second sensor target.

17. The system of claim 16, wherein the first sensor is located above the first sensor target and the second sensor is located above the second sensor target.

18. The system of claim 16, wherein the first sensor and the second sensor are mounted to a bracket attached to the activator switch.

* * * * *